US005156884A

United States Patent [19]

Tanitsu et al.

[11] Patent Number: 5,156,884

[45] Date of Patent: Oct. 20, 1992

[54] METHOD FOR FORMING A FILM OF OXIDIZED METAL

[75] Inventors: Katsuya Tanitsu, Kawasaki; Muneo Nakayama; Akira Hashimoto, both of Tokyo; Toshihiro Nishimura, Kawasaki, all of Japan

[73] Assignee: Tokyo Ohka Kogyo Co., Ltd., Kawasaki, Japan

[21] Appl. No.: 638,016

[22] Filed: Jan. 7, 1991

Related U.S. Application Data

[63] Continuation of Ser. No. 256,943, Oct. 13, 1988, abandoned.

[30] Foreign Application Priority Data

Oct. 23, 1987 [JP] Japan ..... 62-266250

[51] Int. Cl.[5] ..... B05D 3/06; B05D 5/12; B05D 3/02

[52] U.S. Cl. ..... 427/558; 427/126.3; 427/126.4; 427/126.5; 427/126.6; 427/226

[58] Field of Search ..... 427/54.1, 53.1, 126.3, 427/126.4, 126.5, 126.6, 229, 226

[56] References Cited

U.S. PATENT DOCUMENTS

| | | | |
|---|---|---|---|
| 3,502,502 | 3/1970 | Elsby | 427/126.3 |
| 3,663,280 | 5/1972 | Lee | 427/226 |
| 3,850,665 | 11/1974 | Plumat et al. | 427/226 |
| 3,894,164 | 7/1975 | Dismukes et al. | 427/157 |
| 4,129,434 | 12/1978 | Plumat et al. | 427/226 |
| 4,239,816 | 12/1980 | Breininger | 427/168 |
| 4,268,539 | 5/1981 | Nakayama et al. | 427/126.2 |
| 4,279,654 | 7/1981 | Yajima et al. | 427/376.2 |
| 4,401,474 | 8/1983 | Donley | 427/226 |
| 4,444,801 | 4/1984 | Hongo et al. | 427/54.1 |
| 4,485,094 | 11/1984 | Pebler et al. | 427/226 |
| 4,617,207 | 10/1986 | Haisma et al. | 427/53.1 |
| 4,880,492 | 11/1989 | Erdmann et al. | 427/252 |
| 4,888,204 | 12/1989 | Tutt et al. | 427/53.1 |
| 4,900,582 | 2/1990 | Nakayama et al. | 427/299 |
| 4,960,618 | 10/1990 | Tanitsu et al. | 427/126.4 |
| 5,045,348 | 9/1991 | Brierley et al. | 427/54.1 |

*Primary Examiner*—Marianne Padgett

*Attorney, Agent, or Firm*—Armstrong, Nikaido, Marmelstein, Kubovcik & Murray

[57] ABSTRACT

The inventive method comprises the steps of coating the substrate surface with a coating solution containing $\beta$-diketone complex of a metallic element in an aprotic polar solvent, drying and irradiating the coating film on the surface with ultraviolet light, optionally, followed by a heat treatment to form an electrically insulating oxidized metal film on the surface. By virtue of the ultraviolet irradiation, the oxidized metal film can be imparted with increased insulation even by omitting the heat treatment or by decreasing the temperature of the heat treatment so that the adverse influences on the characteristics of the substrate can be minimized.

11 Claims, No Drawings

METHOD FOR FORMING A FILM OF OXIDIZED METAL

This application is a continuation of application Ser. No. 256,943 filed Oct. 13, 1988, now abandoned.

BACKGROUND OF THE INVENTION

The present invention relates to a method for forming a film of oxidized metal or, more particularly, to a method for forming a film of oxidized metal exhibiting greatly increased electric insulation.

As is known, application fields of oxidized metal films are rapidly expanding in recent years with variety including, for example, insulating films or orientation-controlling films in liquid-crystal display units, protecting films on ceramics and metals, insulating films on semiconductor devices and so on. In a liquid-crystal display unit, in particular, an insulating substrate of, for example, glass is provided on the surface with a patterned transparent electroconductive film to serve as the electrodes on which an oxidized metal film is formed to form an electrode substrate and a pair of such electrode substrates each having an oxidized metal film are assembled to face each other with spacers therebetween around the peripheris to form a cell to be filled with a liquid-crystal material.

To give an example in more detail, a glass substrate coated with a surface film of silicon dioxide $SiO_2$, is first provided with a patterned transparent electroconductive film, such as a so-called ITO film composed of oxides of indium and tin, formed thereon as the electrodes and then coated over the whole surface thereof with an insulating film of an oxidized metal.

Such an oxidized metal film is required to have a characteristic that the oxidized metal film per se is electrically highly insulating in addition to the requirements of high adhesion to the substrate and transparent electroconductive film and uniformity of the oxidized metal film per se as a matter of course. Along with the increasing demand in recent years for higher and higher precision in liquid-crystal display units and finer and finer precision of working in transparent electroconductive films, it is a trend in the design of liquid-crystal display units that the distance between adjacent patterned electrodes and the gap space between the oppositely facing electrodes are extremely small. Accordingly, the oxidized metal film formed on the transparent electroconductive film is required to be extremely highly insulating in order to prevent any malfunctioning otherwise possibly taking place between the electrodes.

A method undertaken in the prior art for increasing the electrical insulation of an oxidized metal film is that a coating film for forming an oxidized metal film is formed on the surface of a substrate by using a coating solution for forming an oxidized metal film followed by a heat treatment at a high temperature of at least 400° C., preferably, at least 500 ° C. Although this method is very effective for increasing the electrical insulation of the oxidized metal film per se, it is not always a practically advantageous method because the oxidized metal film is used as formed on an electrode such as a transparent electroconductive film as is mentioned above so that the heat treatment at a high temperature sometimes badly affects the transparent electroconductive film. When a coating film for forming an oxidized metal film is formed over the whole surface of a patterned ITO film and then subjected to a conventional heat treatment to obtain a highly insulating oxidized metal film, a serious drawback is unavoidably caused that the characteristics of the ITO film are affected or, for example, the resistance of the ITO film is disadvantageously increased resulting in a decrease in the performance of the electrode even though the oxidized metal film can be highly insulating. This situation leads to a need of decreasing the temperature in the heat treatment of a coating film for forming an oxidized metal film.

In view of the above described problems, it is eagerly desired to develop a method to increase the electrical insulation of an oxidized metal film useful as an insulating material.

SUMMARY OF THE INVENTION

The present invention accordingly has an object to provide a novel and improved method for forming a uniform and highly insulating oxidized metal film free from the above described problems in the prior art methods.

The method of the invention for forming an oxidized metal film comprises the steps of:

(A) coating the surface of a substrate with a coating solution for forming an oxidized metal film;

(B) drying the thus coated substrate surface to form a dry coating film of the coating solution; and (C) irradiating the dry coating film of the coating solution with ultraviolet light.

Typically, the above mentioned coating solution is a solution of a $\beta$-diketone complex of a metallic element in an aprotic polar solvent.

DETAILED DESCRIPTION OF THE PREFERRED EMBODIMENTS

The first step of the inventive method is coating the surface of a substrate with a coating solution for forming an oxidized metal film. Various types of coating solutions for the purpose are known in the art and can be used in the inventive method without particular limitations provided that an oxidized metal film can be formed on the substrate surface when the coating solution is applied to the surface, dried and subjected to a heat treatment. Coating solutions of a preferable class include solutions of a $\beta$-diketone complex of a metallic element in an aprotic polar solvent. Such a coating solution can be prepared (1) by dissolving a metallic element capable of forming a complex with a $\beta$-diketone compound, a salt of such a metallic element or a hydrolysis product of an alkoxide of such a metallic element in a mixture of $\beta$-diketone and an aprotic polar solvent, (2) by dissolving a $\beta$-diketone complex of a metallic element in a mixture of a $\beta$-diketone and an aprotic polar solvent, or (3) by dissolving a $\beta$-diketone complex of a metallic element in an aprotic polar solvent.

Examples of the metallic element capable of forming a complex with a $\beta$-diketone include the elements belonging to Group Ib of the Periodic Table such as copper, the elements belonging to Group IIa of the Periodic Table such as beryllium, magnesium, calcium, strontium and barium, the elements belonging to Group IIb of the Periodic Table such as zinc and cadmium, the elements belonging to Group IIIa of the Periodic Table such as lanthanum, cerium, scandium and yttrium, the elements belonging to Group IIIb of the Periodic Table such as aluminum, gallium, indium and thallium, the elements belonging to Group IVa of the Periodic Table such as titanium, zirconium and hafnium, the elements belonging to Group IVb of the Periodic Table such as germanium, tin and lead, the elements belonging to Group Va of the Periodic Table such as vanadium, niobium and tantalum, the elements belonging to Group Vb of the Periodic Table such as antimony and bismuth, the elements belonging to Group VIa of the Periodic Table such as chromium, molybdenum and tungsten, the elements belonging to Group VIIa of the Periodic Table such as manganese and rhenium and the elements belonging to Group VIII of the Periodic Table such as iron, cobalt and nickel. Examples of the salt of these metallic elements include inorganic salts such as chlorides, nitrates and sulfates, organic salts such as acetates and octoates, β-diketone complex salts such as acetylacetonato complex salts, biscyclopentadienyl complex salts and the like. Further, a hydrolysis product of an alkoxide of these metallic elements can be used. The above described metallic elements, salts thereof and hydrolysis products of alkoxides thereof can be used either singly or as a combination of two kinds or more according to need.

Examples of the β-diketone compound as a complexing ligand of the metallic element in the coating solution include acetylacetone, trifluoroacetylacetone, hexafluoroacetylacetone, benzoyl acetone, benzoyl trifluoroacetone, dibenzoyl methane, methyl acetoacetate, ethyl acetoacetate, butyl acetoacetate and the as a combination of two kinds or more according to need.

The β-diketone complex of a metallic element used in the preparation of a coating solution used in the inventive method is a complex compound between one of the above mentioned metallic elements and one of the above mentioned β-diketone compounds. Such a complex compound can be prepared by the reaction of a β-diketone compound with a metallic element capable of forming a complex with a β-diketone compound, a salt of such a metallic element other than β-diketone complexes or a hydrolysis product of an alkoxide of such a metallic element.

Examples of the aprotic polar solvent in the coating solution used in the inventive method include N,N-dimethyl formamide, N,N-dimethyl acetamide, acetonitrile, dimethyl sulfoxide, N,N,N',N'-tetraethyl sulfamide, hexamethyl phosphoric triamide, N-methyl morpholone, N-methyl pyrrole, N-ethyl pyrrole, N-methyl-$\Delta^3$-pyrroline, N-methyl piperidine, N-ethyl piperidine, N,N-di-methyl piperazine, N-methyl imidazol, N-methyl-4-piperidone, N-methyl-2-piperidone, N-methyl-2-pyrrolidone, 1,3-dimethyl-2-imidazolidinone, 1,3-dimethyl tetrahydro-2(1H)-pyrimidinone and the like. These solvents can be used either singly or as a mixture of two kinds or more according to need.

In the above described method (1) for the preparation of the coating solution, the weight proportion of (a) the metallic constituent, (b) the β-diketone compound and (c) the aprotic polar solvent is in the ranges of 1 to 60% of (a), 1 to 60% of (b) and 10 to 80% of (c) or, preferably, 1 to 50% of (a), 1 to 50% of (b) and 10 to 70% of (c). In the method (2) for the preparation of the coating solution, in which a β-diketone complex of a metallic element is used in place of the metallic constituent (a), the coating solution is prepared preferably from 1 to 60% by weight of the β-diketone complex and 40 to 99% by weight of the aprotic polar solvent.

It is optional that the coating solution obtained in this manner is admixed with a compound of a non-metallic element such as silicon, selenium and tellurium including halides, hydroxides, oxides, salts of inorganic acids, salts of organic salts, alkoxy compounds and chelate compounds as well as organometallic compounds with an object to further improve the characteristics of the oxidized metal film.

It is further optional that the coating solution for forming an oxidized metal film is admixed with an organic solvent other than aprotic polar solvents with an object to improve the properties of the coating film. Examples of suitable organic solvents include methyl alcohol, ethyl alcohol, isopropyl alcohol, n-propyl alcohol, n-butyl alcohol, ethylene glycol, propylene glycol, butylene glycol, hexylene glycol, octylene glycol, diethylene glycol, dipropylene glycol, dihexylene glycol, ethylene glycol monomethyl ether, ethylene glycol monoethyl ether, ethylene glycol monobutyl ether, ethylene glycol monopropyl ether, ethylene glycol monophenyl ether, ethylene glycol monobenzyl ether, propylene glycol monomethyl ether, propylene glycol monoethyl ether, propylene glycol monobutyl ether, ethylene glycol dimethyl ether, ethylene glycol diethyl ether, ethylene glycol methyl ethyl diether, ethylene glycol dibutyl ether, ethylene glycol diphenyl ether, ethylene glycol dibenzyl ether, propylene glycol dimethyl ether, propylene glycol diethyl ether, propylene glycol dibutyl ether, methyl carbitol, ethyl carbitol, butyl carbitol, phenyl carbitol, benzyl carbitol, dimethyl carbitol, diethyl carbitol, dibutyl carbitol, diphenyl carbitol, dibenzyl carbitol, methyl ethyl carbitol, dipropylene glycol dimethyl ether, dipropylene glycol diethyl ether, dipropylene glycol dibutyl ether and the like. These organic solvents can be used either singly or as a combination of two kinds or more according to need.

The amount of these optional organic solvents, used in the inventive method in the coating solution/should not exceed 80% by weight or, preferably, in the range from 30 to 70% by weight based on the total amount of the metallic constituent, β-diketone compound and aprotic polar solvent or total amount of the β-diketone complex of a metallic element and aprotic polar solvent. An excessively large amount of the organic solvent in the coating solution is undesirable due to the possible decrease in the coating performance of the solution, adhesion of the coating film to the substrate surface and strength of the coating film.

In practicing the inventive method for forming an oxidized metal film, the surface of a substrate is coated with the above described coating solution by a conventional method such as dipping method, spraying method, spin-coating method, brushing method, roll-coating method, printing method and the like followed by drying at a temperature not exceeding 200 ° C. to form a uniform coating film for forming an oxidized metal film with good adhesion to the substrate surface. The inventive method is applicable to substrates of various kinds of materials including substrates of plastics, glass, ceramics and sintered bodies of powdery metal nitrides or metal carbides, substrates for various kinds of display units having a patterned transparent electroconductive film formed thereon as an electrode, semiconductor substrates and the like.

The characteristic feature of the inventive method for forming an oxidized metal film consists in the irradiation of a coating film for forming an oxidized metal film formed on the substrate surface in the above described manner with ultraviolet light. The irradiation with ultraviolet light is performed preferably by using an ultraviolet light-emitting lamp from the practical standpoint.

Examples of suitable ultraviolet light emitting lamp include high pressure mercury lamps, extrahigh pressure mercury lamps, metal halide lamps, xenon lamps and the like. The ultraviolet lamp should preferably have an illuminance of at least 10 mW/cm$^2$ at the wavelength of 253.7 nm. More preferably, the lamp should also have an output at the wavelength of 185 nm. The atmosphere in which the ultraviolet irradiation is performed can be either under normal pressure or under reduced pressure. When the irradiation is performed under normal pressure, the atmospheric gas may be air, an inert gas, e.g., nitrogen gas, or an ozone-containing gas. When the ultraviolet irradiation is performed under reduced pressure, the pressure inside the treatment chamber is 4000 Pa or lower or, preferably, 1500 Pa or lower.

The ultraviolet irradiation of the coating film under the above described conditions in the inventive method should be followed by a heat treatment so that a highly insulating oxidized metal film can be obtained. In particular, it is preferable that the ultraviolet irradiation is performed under a reduced pressure or in an ozone-containing atmosphere because the oxidized metal film can be imparted with increased electrical insulation and denseness and freed from occurrence of pinholes and cracks. It is further optional that the ultraviolet irradiation of the coating film is performed by heating the coating film at a temperature where the substrate of the coating film is not adversely influenced. In practice, the heating temperature is preferably in the range from 100° to 200 ° C.

When the ultraviolet irradiation of the coating film is performed in an ozone-containing atmosphere, the ozone is introduced into the treatment chamber as diluted with nitrogen gas, oxygen gas or a gaseous mixture of nitrogen and oxygen such as atmospheric air. The concentration of ozone in the gaseous mixture introduced into the treatment chamber is at least 1% by weight. An ozone generator can be used as a supply source of the ozone-containing gas. It is a fair presumption that the concentration of ozone in the atmospheric gas should be as high as possible from the experimental results that improvement as a trend in the properties of the oxidized metal film could be obtained when the concentration of ozone was increased from 1% by weight to 10% by weight, this concentration of 10% by weight being approximately the upper limit which can be achieved by using a commercial product of ozone generators.

Though not essential in the inventive method, it is desirable that the coating film after the ultraviolet irradiation is then subjected to a heat treatment so that the oxidized metal film of increased electrical insulation obtained by the ultraviolet irradiation of the coating film for forming an oxidized metal film can be imparted with further increased electrical insulation.

The temperature of the heat treatment after the ultraviolet irradiation is limited by the heat resistance of the substrate material. Namely, the heat treatment should be performed at such a temperature that the substrate is not adversely influenced by the heat treatment. In the manufacture of a liquid-crystal display unit by forming an oxidized metal film on a patterned ITO film, for example, the temperature of the heat treatment is preferably in the range from 300° to 500 ° C. in order that the ITO film is not adversely affected by the heat treatment.

In the following, the method of the present invention is described in more detail by way of examples.

EXAMPLE 1

A substrate plate of glass having a thickness of 1.1 mm was first provided with patterned electrodes of ITO film formed from indium and tin oxides with a distance between electrodes of 100 μm and then coated with a coating solution for forming a $TiO_2$-$SiO_2$ based coating film (MOF Ti-Si-INK-Film, a product by Tokyo Ohka Kogyo Co.) by spin coating in such coating amounts that the thickness of the finished oxidized metal films should be 50 nm, 100 nm and 150 nm followed by drying at 140 ° C. for 15 minutes to give three substrates each bearing a coating film for forming a $TiO_2$-$SiO_2$ film of different thickness.

In the next place, each of the three substrates was subjected to an ultraviolet irradiation treatment in three different ways (i), (ii) and (iii) described below by using an ultraviolet treatment apparatus (Model TVC-5002, a product by Tokyo Ohka Kogyo Co.) having a treatment chamber provided with a gas inlet port and a gas discharge port and a stage movable up and down and provided with a hot plate to serve as a heating member, the stage serving to close the treatment chamber airtightly when it is at the highest position.

(i) The substrate was heated at 100 ° C. by mounting the same on the stage kept at a temperature of 100 ° C. and then the treatment chamber was closed by elevating the stage to its highest position. Thereafter, the treatment chamber was evacuated to have a reduced pressure of 26.6 Pa by operating the vacuum system and the coating film for forming a $TiO_2$-$SiO_2$ film was irradiated for 5 minutes with ultraviolet light of an illuminance of 20 mW/cm$^2$ at a wavelength of 253.7 nm.

(ii) The substrate was heated at 100 ° C. by mounting the same on the stage kept at a temperature of 100 ° C. and then the treatment chamber was closed by elevating the stage to its highest position. Thereafter, the coating film for forming a $TiO_2$-$SiO_2$ film was irradiated in air with ultraviolet light in the same manner as in (i) described above.

(iii) The substrate was heated at 100 ° C. by mounting the same on the stage kept at a temperature of 100 ° C. and then the treatment chamber was closed by elevating the stage to its highest position. Thereafter, the coating film for forming a $TiO_2$-$SiO_2$ film was irradiated with ultraviolet light in the same manner as in (i) described above while the treatment chamber was filled with air containing 6.75% by weight of ozone generated in an ozone generator introduced into the chamber through the gas inlet port at a rate of 10 liters/minute.

The substrates after the treatment in the above described manner were each put into an oven and subjected to a heat treatment for 30 minutes at 350 ° C. to form a $TiO_2$-$SiO_2$ film of which the electric resistance between the electrodes was measured by using a high-sensitivity electronic tester (Model EM-3000, a product by Sanwa Denki Keiki Co.) to find that the resistance was infinitely large within the limit of the instrument in each of the substrates irrespective of the film thickness which was 50 nm, 100 nm or 150 nm.

For comparison, the same procedure as above was repeated except that the ultraviolet irradiation treatment was omitted and, instead, the temperature was 250 ° C., 300 ° C., 350 ° C. or 400 ° C. in the heat treatment. Table 1 below shows the results obtained in the measurement of the electric resistance of the $TiO_2$-$SiO_2$ films between the electrodes.

The above described results of the comparative experiments clearly indicate that the ultraviolet irradiation treatment according to the inventive method is very effective to impart the $TiO_2$-$SiO_2$ film with greatly increased electric insulation.

EXAMPLE 2

The same experimental procedure as in Example 1 was repeated except that the temperature of the substrate during the ultraviolet irradiation was increased from 100 ° C. to 200 ° C. The results obtained in the measurement of the electric resistance of the films between electrodes were that the resistance was infinitely large within the limit of the instrument irrespective of the film thickness.

TABLE 1

| Temperature of heat treatment, °C. | Electric resistance between electrodes, M ohm, of $TiO_2$—$SiO_2$ film having thickness of | | |
|---|---|---|---|
| | 50 nm | 100 nm | 150 nm |
| 250 | 330-450 | 500-900 | 150-200 |
| 300 | 700-800 | 1000-2000 | 300-400 |
| 350 | 900-1000 | 2000-5000 | 500-1000 |
| 400 | 5000-∞ | 5000-∞ | 1000-2000 |

EXAMPLE 3

Three substrate plates of glass having a thickness of 1.1 mm were each first provided with patterned electrodes of ITO film formed from indium and tin oxides with a distance between electrodes of 100 μm and then coated with a coating solution for forming a $TiO_2$-based coating film (MOF Ti-INK-Film, a product by Tokyo Ohka Kogyo Co.) by spin coating in such a coating amount that the thickness of the finished oxidized metal film should be 100 nm followed by drying at 140 ° C. for 15 minutes to give substrate plates provided with a coating film for forming a $TiO_2$ film formed on the surface.

In the next place, these three substrate plates were irradiated with ultraviolet light under the same conditions of (i), (ii) and (iii) as in Example 1, respectively, followed by a heat treatment at 350 ° C. for 30 minutes. The thus formed $TiO_2$ films on the substrate surfaces had an infinitely large resistance between the electrodes within the limit of the instruments irrespective of the conditions of the ultraviolet irradiation.

For comparison, four more substrate plates were coated with the same coating solution in the same manner as above and subjected to a heat treatment alone at 250 ° C., 300 ° C., 350 ° C. for 30 minutes and 400 ° C./with omission of the ultraviolet irradiation to form $TiO_2$ films on the surface, of which the values of the electric resistance between the electrodes were 500 to 700 M ohm, 700 to 1000 M ohm, 2000 to 5000 M ohm and 1500 to 2000 M ohm for the heat treatment temperatures of 250 ° C., 300 ° C., 350 ° C. and 400 ° C., respectively.

EXAMPLE 4

Three substrate plates of glass having a thickness of 1.1 mm were each first provided with patterned electrodes of ITO film formed from indium and tin oxides with a distance between electrodes of 100 μm and then coated with a coating solution for forming an $Al_2O_3$-based coating film (MOF Al-INK-Film, a product by Tokyo Ohka Kogyo Co.) by spin coating in such a coating amount that the thickness of the finished oxidized metal film should be 100 nm followed by drying at 140 ° C. for 15 minutes to give substrate plates provided with a coating film for forming an $Al_2O_3$ film on the surface.

In the next place, these three substrate plates were irradiated with ultraviolet light under the same conditions of (i), (ii) and (iii) as in Example 1, respectively, except that the ultraviolet irradiation was performed at room temperature followed by a heat treatment at 350 ° C. for 30 minutes. The thus formed $Al_2O_3$ films on the substrate surfaces had an infinitely large electric resistance between the electrodes within the limit of the instrument irrespective of the conditions of the ultraviolet irradiation.

For comparison, four more substrate plates were coated with the same coating solution in the same manner as above and subjected to a heat treatment alone for 30 minutes at 250 ° C., 300 ° C., 350 ° C. and 400 ° C. with omission of the ultraviolet irradiation to form $Al_2O_3$ films on the surface, of which the values of the electric resistance between the electrodes were 70 to 120 M ohm, 50 to 70 M ohm, 50 to 70 M ohm and 50 to 70 M ohm for the heat treatment temperatures of 250 ° C., 300 ° C., 350 ° C. and 400 ° C., respectively.

As is described above, a highly insulating and uniform oxidized metal film can be formed on the substrate surface according to the method of the present invention merely by irradiating the coating film for forming an oxidized metal film with ultraviolet light. In particular, a coating film for forming an oxidized metal film formed on the surface of a substrate having electrodes of a patterned transparent electroconductive film as in the manufacture of liquid-crystal display units can be imparted with greatly increased electric insulation according to the inventive method without undertaking a heat treatment at a high temperature as in the conventional methods. Therefore, a highly insulating oxidized metal film can be formed on the electrodes without affecting the characteristics of the electrodes. The applicability of the inventive method covers all of the industrial fields where a highly insulating oxidized metal film is required.

What is claimed is:

1. A method for forming an oxidized metal film on the surface of a substrate which comprises the successive steps of:

(A) coating the substrate surface with a coating solution for forming an oxidized metal film;

(B) drying the thus coated substrate surface to form a dry coating film of the coating solution, said dry coating film comprising a complex of a metallic element with a β-diketone;

(C) irradiating the dry coating film of the coating solution with ultraviolet light under a reduced pressure, thereby increasing the electrically insulating property of the dry coating film; and (D) heating the coating film after the irradiation with ultraviolet light at an elevated temperature, thereby further increasing the electrically insulating property of the dry coating film.

2. The method for forming an oxidized metal film on the surface of a substrate as claimed in claim 1 wherein the coating solution for forming an oxidized metal film is selected from the group consisting of:

(i) a solution comprising a solvent mixture composed of the β-diketone and an aprotic polar solvent and the metallic element capable of forming said complex with the β-diketone, a salt of the metallic element or a hydrolysis product of an alkoxide of the metallic element dissolved in the solvent mixture;

(ii) a solution comprising a solvent mixture composed of the β-diketone and an aprotic polar solvent and said complex of said metallic element with the β-diketone dissolved in the solvent mixture; and (iii) a solution comprising an aprotic polar solvent and said complex of the metallic element with the β-diketone dissolved in the solvent.

3. The method for forming an oxidized metal film on the surface of a substrate as claimed in claim 2 wherein the β-diketone is selected from the group consisting of acetylacetone, trifluoroacetylacetone, hexafluoroacetylacetone, benzoyl acetone, benzoyl trifluoroacetone, dibenzoyl methane, methyl acetoacetate, ethyl acetoacetate and butyl acetoacetate.

4. The method for forming an oxidized metal film on the surface of a substrated as claimed in claim 1 wherein the irradiation of the dry coating film with ultraviolet light is performed by using a lamp emitting ultraviolet light with an illuminance of at least 10 $mW/cm^2$ at a wavelength of 253.7 nm.

5. The method form forming an oxidized metal film on the surface of a substrate as claimed in claim 1 wherein the irradiation of the dry coating film with ultraviolet light in step (C) is performed by simultaneously heating and irradiating the substrate.

6. The method for forming an oxidizing metal film on the surface of a substrate as claimed in claim 5 wherein the substrate is in the range of from 100° C. to 200° C.

7. The method for forming an oxidized metal film on the surface of a substrate as claimed in claim 1 wherein the elevated temperature in step (D) is in the range from 300° C. to 500° C.

8. A method for forming an oxidized metal film on the surface of a substrate bearing a patterned transparent electroconductive film formed thereon which comprises the successive steps of:

(A) coating the surface of the patterned transparent electroconductive film with a coating solution for forming an oxidized metal film;

(B) drying the thus coating surface to form a dry coating film of the coating solution, said dry coating film comprising a complex of a metallic element with a β-diketone;

(C) irradiating the dry coating film of the coating solution with ultraviolet light, thereby increasing the electrically insulating property of the dry coating film; and (D) heating the coating film after the irradiation with ultraviolet light at an elevated temperature, thereby further increasing the electrically insulating property of the dry coating film.

9. The method for forming an oxidized μmetal film on the surface of a substrate as claimed in claim 8 wherein the patterned transparent electroconductive film is a film of indium oxide and tin oxide.

10. A method for forming an oxidized metal film on the surface of a substrate which comprises the successive steps of:

(A) coating the substrate surface with a coating solution for forming an oxide metal film;

(B) drying the thus coated substrate surface to form a dry coating film of the coating solution, said dry coating film comprising a complex of a metallic element with a β-diketone;

(C) irradiating the dry coating film of the coating solution with ultraviolet light in an atmosphere of a gas containing ozone, thereby increasing the electrically insulating property of the dry coating film; and (D) heating the coating film after the irradiation with ultraviolet light at an elevated temperature, thereby further increasing the electrically insulating property f the dry coating film.

11. The method for forming an oxidized metal film on the surface of a substrate as claimed in claim 10 wherein the concentration of ozone in the gas of the atmosphere is at least 1% by weight.

* * * * *